US005147843A

United States Patent [19]

Bodem et al.

[11] Patent Number: 5,147,843

[45] Date of Patent: Sep. 15, 1992

[54] POLYVINYL ALCOHOL AND POLYVINYL PYRROLIDONE MIXTURES AS DYE-DONOR SUBBING LAYERS FOR THERMAL DYE TRANSFER

[75] Inventors: George B. Bodem, Pittsford; Karen M. Kosydar, Penfield, both of N.Y.

[73] Assignee: Eastman Kodak Company, Rochester, N.Y.

[21] Appl. No.: 700,988

[22] Filed: May 16, 1991

[51] Int. Cl.[5] ..... B41M 5/035; B41M 5/26

[52] U.S. Cl. ..... 503/227; 428/195; 428/341; 428/480; 428/500; 428/520; 428/913; 428/914

[58] Field of Search ..... 8/471; 428/195, 341, 428/480, 500, 520, 913, 914; 503/227

[56] References Cited

U.S. PATENT DOCUMENTS 4,547,456 10/1985 Kojima et al. ..... 430/330
4,591,544 5/1986 Sasa et al. ..... 430/166
4,700,208 10/1987 Vanier et al. ..... 503/227
4,716,144 12/1987 Vanier et al. ..... 503/227
4,734,397 3/1988 Harrison et al. ..... 503/227
4,748,149 5/1988 Byers ..... 503/227
4,770,981 9/1988 Komamura et al. ..... 430/505

FOREIGN PATENT DOCUMENTS

62/128792 11/1985 Japan ..... 503/227

*Primary Examiner*—Bruce H. Hess
*Attorney, Agent, or Firm*—Clyde E. Bailey

[57] ABSTRACT

A dye-donor element for thermal dye transfer comprises a support, a hydrophilic dye barrier/subbing layer comprising a mixture of polyvinyl alcohol (PVA) and polyvinylpyrrolidone (PVP) and a dye layer. The PVA is present in the mixture from about 15 to about 35 weight-percent. The dye-barrier/subbing layer provides improved dye transfer densities.

13 Claims, No Drawings

POLYVINYL ALCOHOL AND POLYVINYL PYRROLIDONE MIXTURES AS DYE-DONOR SUBBING LAYERS FOR THERMAL DYE TRANSFER

TECHNICAL FIELD

This invention relates to dye-donor elements used in thermal dye transfer, and more particularly to the use of dye-barrier/subbing layers to provide improved dye transfer densities.

In recent years, thermal transfer systems have been developed to obtain prints from a color video camera. According to one way of obtaining such prints, an electronic picture is first subjected to color separation by color filters. The respective color-separated images are then converted into electrical signals. These signals are then operated on to produce cyan, magenta and yellow electrical signals. Then the signals are transmitted to a thermal printer. To obtain the print, a cyan, magenta and yellow dye-donor element is placed face-to-face with a dye receiving element. The two are then inserted between a thermal printing head and a platen roll. A line-type thermal printing head is used to apply heat from the back of the dye-donor sheet. The thermal printing head has many heating elements and is heated up sequentially in response to the cyan, magenta and yellow signals. The process is then repeated for the other two colors. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye layers which are coated directly on a support for a dye-donor element for thermal dye transfer printing, such as poly(ethylene terephthalate), experience loss of dye by uncontrolled non-directionalized diffusion into the support during the transfer process. The dye-donor support softens during heating and has the inherent property to act as a receiver for the dye. Dye which is lost by this wrong way diffusion results in less dye being transferred to the dye receiving element. Since the background density in a thermal dye transfer system is essentially constant, any density increase in image areas results in improved discrimination, which is highly desirable.

It is therefore an object of the invention to provide a dye-barrier/subbing layer which provides effective adhesion between the dye layer and the support.

Still another object of the invention is to provide a way to increase the density of the transferred dyes.

Moreover an important advantage of the present invention is the absence of dye layer delamination generally associated with other dye-barrier/subbing layers.

Yet another advantage of the present invention is that the subbing/barrier layer can be easily coated.

BACKGROUND ART

U.S. Pat. No. 4,716,144 is directed to a hydrophilic dye barrier layer located between the dye layer and the subbing layer which is coated on a support of a dye-donor element for thermal dye transfer. There is no disclosure in this patent that teaches a hydrophilic dye-barrier/subbing layer comprising a mixture of polyvinyl alcohol and polyvinylpyrrolidone.

U.S. Pat. No. 4,700,208 is directed to a dye-donor element for thermal dye transfer comprising a hydrophilic dye-barrier/subbing layer located between a dye layer and a support layer. There is no disclosure in this patent that teaches a hydrophilic dye-barrier/subbing layer comprising a mixture of polyvinyl alcohol and polyvinylpyrrolidone.

Japanese Kokai Publication No. 62/128792 discloses a heat transfer sheet for thermal dye transfer printing. The sheet has a dye-transfer-preventative layer comprising more than 60 weight percent of a cellulosic resin or polyvinyl alcohol mixed with a polyester resin. The subject publication does not disclose or suggest a subbing/barrier layer comprising a mixture of polyvinyl alcohol and polyvinyl pyrrolidone in the range claimed.

SUMMARY OF THE INVENTION

According to the present invention, a dye-donor element for thermal dye transfer comprises a support having thereon a dye layer, and wherein a hydrophilic dye-barrier/subbing layer is located between the dye layer and the support. The hydrophilic dye-barrier/subbing layer of the invention comprises a mixture of polyvinyl alcohol from about 15 to about 35 weight-percent, and polyvinyl-pyrrolidone from about 65 to about 85 weight-percent of the mixture.

BEST MODE OF CARRYING OUT THE INVENTION

In a preferred embodiment of the invention, the dye barrier/subbing layer is present in an amount of up to 0.11 $g/m^2$.

In another preferred embodiment, the PVA is present in the mixture from about 20 to about 25 weight-percent.

The subbing/barrier layer of the present invention is obtained by coating a mixture of PVA and PVP in a solvent primarily of methanol or water.

The hydrophilic polymers described above which are used in the invention function as a dye-barrier layer since most of the dyes used in thermal dye transfer printing are hydrophobic, as noted below, and they have negligible affinity for or solubility in hydrophilic material. Thus the barrier layer functions to prevent wrong-way transfer of the dye into the donor support, with the result that the density of the transferred dye is increased.

The hydrophilic polymers described above which are used in the invention also have effective adhesion to the support and the dye layer, thus eliminating he need for a separate subbing layer. The particular hydrophilic polymers described above used in a single layer in the donor element thus perform a dual function, hence are referred to as dye-barrier/subbing layers.

Any dye can be used in the dye layer of the dye-donor element of the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

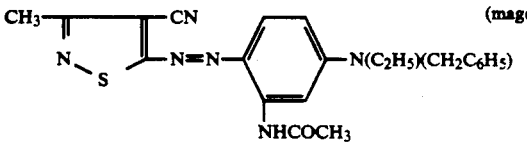

(magenta)

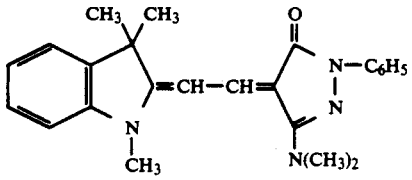

(yellow)

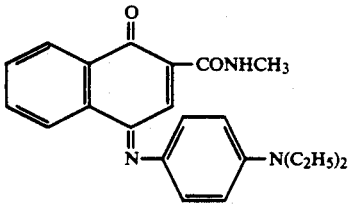

(cyan)

or any of the dyes disclosed in U.S. Pat. Nos. 4,541,830, 4,698,651, 4,695,287 , 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any polymeric material can be used as the support for the dye-donor element of the invention provided it is dimensionally stable and can withstand the heat of the thermal printing head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 30 μm.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyesters, poly(capro-lactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight-percent, preferably 0.5 to 40 weight percent, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as duPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have a sublimable yellow and/or cyan and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The invention will be further clarified by a consideration of the following examples, which are intended to be purely exemplary of the use of the invention.

EXAMPLE 1

Dye-donor elements were prepared by coating the following layers in order on a 6 μm poly(ethylene terephthalate) support:

1) a subbing layer of a mixture of polyvinyl alcohol and polyvinylpyrrolidone at the indicated ratio (total 0.11 g/m$^2$) from a water-methanol mixture, and
2) a dye-layer containing the yellow dye illustrated below (0.15 g/m$^2$) in a cellulose acetate propionate binder (2.5% acetyl, 45% propionyl) (0.36 g/m$^2$) coated from a toluene, methanol, and cyclopentanone solvent mixture.

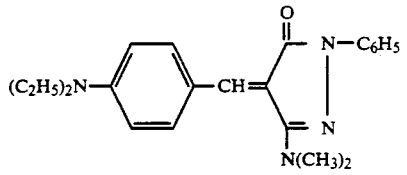

On the back side of the donor was coated a slipping layer of Emralon 329®, a dry film lubricant of poly(tetrafluoroethylene) particles, (Acheson Colloids Co.) (0.54 g/m$^2$) coated from a n-propyl acetate, toluene, isopropyl alcohol and n-butyl alcohol solvent mixture.

Comparison dye-donors were also prepared with only polyvinyl alcohol (0.11 g/m$^2$), only polyvinyl pyrrolidone (0.11 g/m$^2$) or mixtures of these materials (total of 0.11 g/m$^2$) as the subbing layer. Polyvinyl alcohol mixed with polyacrylic acid (50:50 wt. ratio) or polyvinyl acetate (80:20 wt ratio) (0.11 g/m$^2$) were also coated. Four additional prior art control subbing layers were also coated: Tyzor TBT® (titanium tetra-n-butoxide) (duPont) (0.11 g/m$^2$) (described in U.S. Pat. No. 4,695,288), poly(acrylonitrile-co-vinylidene chloride-co-acrylic acid) (14:80:6 wt. ratio) (0.22 g/m$^2$) (described in U.S. Pat. No. 4,737,486) and mixtures of polyvinyl alcohol with either polyacrylic acid (50:50 wt ratio) or polyvinyl acetate (80:20 wt. ratio) (each at 0.43 g/m$^2$) coated over the vinylidene chloride derived polymer (0.21 g/m$^2$) (described in U.S. Pat. No. 4,716,144).

Dye receiving elements were prepared by layers in order on a white-reflective support of titanium dioxide pigmented polyethylene overcoated paper stock:

1) Subbing layer of poly(acrylonitrile-covinylidene chloride-co-acrylic acid)(14:79:7 wt. ratio) (0.08 g/m$^2$) coated from butanone;
2) Dye-receiving layer of diphenyl phthalate (0.32 g/m$^2$), di-n-butyl phthalate (0.32 g/m$^2$), and Fluorad FC-431® (a perfluoro-sulfonamido surfactant) (3M Corp.) (0.01 g/m$^2$), in a mixture of Makrolon 5700® (a bisphenol-A-polycarbonate) (Bayer AG) (1.6 g/m$^2$) and a linear condensation polymer derived from carbonic acid, bisphenol-A, and diethylene glycol (bisphenol: glycol mole ratio 50:50, molecular weight approx. 200,000) (1.6 g/m$^2$) coated from dichloromethane;
3) Overcoat layer of the bisphenol-A-glycol polycarbonate listed above (0.22 g/m$^2$) containing Fluorad FC-431®(0.01 g/m$^2$), 510 Silicone Fluid (Dow Corning) (0.016 g/m$^2$) coated from dichloromethane.

On the reverse side of each dye-receiving element a backing layer (not critical to the invention) was coated as described in Example 1 of U.S. application Ser. No. 547,480, filed on Jun. 28, 1990.

The dye side of the dye-donor element, approximately 10 cm ×15 cm in area, was placed in contact with the polymeric receiving layer side of the dye-receiver element of the same area. The assemblage was fastened to the top of a motor-driven 56 mm diameter rubber roller and a TDK Thermal Head L-231, thermostatted at 26° C. was pressed with a spring at a force of 36 Newtons against the dye-donor element side of the assemblage pushing it against the rubber roller. This print head has 512 independently addressable heaters with a resolution of 5.4 dots/mm and an active printing width of 95 mm, of average heater resistance 511 ohms.

The imaging electronics were activated and the assemblage was drawn between the printing head and roller at 6.8 mm/sec.

Coincidentally, the resistive elements in the thermal print head were pulsed on for 128 msec every 130 msec. Since the duty cycle for each pulse is 98.5%, this approximates pulse width modulation. Printing maximum density requires 154 pulses "on" time per printed line of 19.7 msec for 33.8 msec allotted print time or 58.2% duty cycle. The voltage supplied was 14 volts resulting in an instantaneous peak power of approximately 0.38 watts/dot and the maximum total energy required to print a maximum density of 2.3 was 7.6 mjoules/dot.

After one stepped density image was generated, the printing cycle was repeated with a new area of dye-donor onto the same area of dye-receiver. This was repeated until the receiver showed sticking to the dye-donor upon separation. The number of the first print which showed sticking was recorded as "prints to fail". A value of greater than 6 indicated that no sticking was observed on the 6th transfer and the test was discontinued.

In a separate experiment each unincubated dye-donor was printed once with a given receiver and the Status A Blue maximum dye density was recorded.

The effect of dye decomposition in the dye-donor was evaluated by measuring the Status A blue transmission density before and after incubation at 50° C., 50% RH for 7 days and calculating the percent density loss. Only the dye donor with the titanium butoxide subbing layer showed a loss of approximately 15% in dye density , all other donors lost less than 5% density.

For the criteria of the invention at least four "prints to fail" (i.e. obtaining 3 good prints without sticking), a maximum transferred density of at least 2.2, and less than 3% dye loss upon incubation were specified. The following results were obtained:

TABLE 1

| Subbing Layer | Coverage ($g/m^2$) | Prints to Fail | D-Max |
|---|---|---|---|
| None (Control) | | 2 | 2.2 |
| Titanium alkoxide (control) | 0.11 | 5 | 2.3 |
| Polyvinylidene chloride copolymer (control) | 0.22 | >6 | 1.6 |
| Polyvinyl alcohol/poly acrylic acid (50:50 wt %) (control) | 0.11 | 2 | 2.3 |
| Polyvinyl alcohol/polyvinyl acetate (80:20 wt %) (control) | 0.11 | 2 | 2.2 |
| Polyvinyl alcohol/polyacrylic acid (50:50 wt %) over polyvinylidene chloride copolymer (control) | 0.43 over 0.22 | 2 | 2.3 |
| Polyvinyl alcohol/polyvinylacetate acid (80:20 wt %) over polyvinylidene chloride copolymer (control) | 0.43 over 0.22 | 2 | 1.9 |
| PVA/PVP 100/0 (comparison) | 0.11 | 2 | 2.3 |
| 80/20 (comparison) | 0.11 | 2 | 2.3 |
| 60/40 (comparison) | 0.11 | 2 | 2.3 |
| 40/60 (comparison) | 0.11 | 3 | 2.3 |
| 35/65 (invention) | 0.11 | 4 | 2.3 |
| 30/70 (invention) | 0.11 | 4 | 2.3 |
| 25/75 (invention) | 0.11 | 4 | 2.3 |
| 20/80 (invention) | 0.11 | 5 | 2.2 |
| 15/85 (invention) | 0.11 | >6 | 2.2 |
| 10/90 (comparison) | 0.11 | >6 | 2.0 |
| 5/95 (comparison) | 0.11 | >6 | 2.0 |
| 0/100 (comparison) | 0.11 | 5 | 2.0 |
| PVA/PVP 60/40 (comparison) | 0.22 | 3 | 2.3 |
| 40/60 (comparison) | 0.22 | 4 | 2.3 |
| 30/70 (comparison) | 0.22 | 3 | 2.3 |
| 25/75 (invention) | 0.22 | 4 | 2.3 |
| 20/80 (invention) | 0.22 | 4 | 2.2 |
| 15/85 (comparison) | 0.22 | >6 | 2.1 |
| 10/90 (comparison) | 0.22 | >6 | 1.8 |
| 0/100 (comparison) | 0.22 | >6 | 1.7 |
| PVA/PVP 60/40 (comparison) | 0.054 | 3 | 2.3 |
| 30/70 (comparison) | 0.054 | 3 | 2.3 |
| 25/75 (invention) | 0.054 | 4 | 2.3 |
| 20/80 (invention) | 0.054 | 5 | 2.3 |
| 15/85 (invention) | 0.054 | >6 | 2.2 |
| 10/90 (invention) | 0.054 | >6 | 2.2 |
| 0/100 (comparison) | 0.054 | >6 | 2.1 |

The results indicate that the dye-donor element having a subbing/barrier layer in accordance with the present invention gave superior adhesion performance as a subbing layer by minimizing sticking and not lowering the transferred maximum dye density as compared to prior art subbing layer control subbing layers. Titanium tetra-n-butoxide does not cause print sticking but does cause severe yellow dye density loss, and poly(acrylonitrile-co-vinylidene chloride-co-acrylic acid) produces lower transferred dye density. Subbing layers involving polyacrylic acid or polyvinyl acetate produced excessive sticking. Regardless of the subbing layer coverage, 20–25% PVA mixed with PVP is considered effective and highly preferred. When subbing layer coverages of 0.11 $g/m^2$ were used (a coverage considered preferred) effective results were obtained with as little as 15% PVA or as much as 35% PVA. Polyvinyl pyrrolidone only (or low amounts of PVA in the mixture) produced low transferred dye density, whereas polyvinyl alcohol alone (or low amounts of PVP in the mixture) produced print sticking.

EXAMPLE 2

This example is similar to Example 1 but shows that the donor incubation evaluation is a valid criteria for producing less transferred dye density to the receiver upon printing.

Dye-donors were those of Example 1. Two selected were a control with titanium tetra-n-butoxide as a subbing layer and a polyvinyl alcohol-polyvinylpyrrolidone mixture at a 20/80 weight ratio.

Dye-receivers were prepared by coating the following layers in order on a white reflective support of titanium dioxide pigmented polyethylene overcoated paper stock:

1) Subbing layer of poly(acrylo-nitrile) covinylidene chloride-co-acrylic acid (14:79:7 wt. ratio) (0.08 $g/m^2$)coated from butanone;
2) A mixture of Makrolon 5700® (a bisphenol-A-polycarbonate) (Bayer AG(2.9 $g/m^2$) Tone PCL-300® (polycaprolactone) (Union Carbide) (0.38 $g/m^2$) containing 1,4-didecoxy-2,5-dimethoxybenzene (0.38 $g/m^2$) coated from dichloromethane;
3) Tone PCL-300® (0.11 $g/m^2$) containing Fluorad FC-431® (a perfluorosulfonamido surfactant) (3M Corp.) (0.01 $g/m^2$) and 510® Silicone Fluid (Dow Corning Co.)(0.01 $g/m^2$) coated from dichloromethane.

On the reverse side of each dye-receiving element a backing layer (not critical to the invention) was coated as described in Example 1 of U.S. application Ser. No. 547,480 referred to above.

The effect of dye decomposition in dye-donor was evaluated by measuring the Status A blue transmission density before and after incubation at 50° C., 50% RH for 7 days and calculating the percent density loss.

The printing procedure was the same as described in Example 1 except each dye-donor was printed before and after incubation at 50° C., 50% RH for 7 days and the percent Status A slue maximum reflection dye density change was recorded. The following results were obtained:

TABLE 2

| Subbing Layer | Status A Blue Print Density | | | % Density Loss in Donor Upon Incubat. |
|---|---|---|---|---|
| | No Incubat. | Incubat. | Percent Loss | |
| Titanium Alkoxide (control) | 2.3 | 2.1 | 10 | 12 |
| PVA/PVP 20/80 (invention) | 2.3 | 2.3 | 0 | 5 |

The results indicate that the dye-donor element having a subbing/barrier layer in accordance with the present invention produces 5% or less density loss in the donor. Density losses greater than 5%, according to the data, greatly reduce the printed density on the receiver.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer, the improvement wherein a hydrophilic dye-barrier/subbing layer is located between said dye layer and said support, said dye-barrier/subbing layer comprising a mixture of a) polyvinyl alcohol from about 15 to about 35 weight-percent, and b) polyvinyl-pyrrolidone from about 65 to about 85 weight-percent of said mixture.

2. The element of claim 1 wherein said dye-barrier/subbing layer is present in an amount of up to about 0.11 $g/m^2$.

3. The element of claim 1 wherein said dye layer comprises a sublimable dye in a binder.

4. The element of claim 1 wherein said support comprises poly(ethylene terephthalate).

5. The element of claim 4 wherein said dye layer comprises sequential repeating areas of cyan, magenta and yellow dye.

6. In a process of forming a dye transfer image comprising imagewise-heating a dye-donor element comprising a support having thereon a dye layer and transferring a dye image to a dye-receiving element to form said dye transfer image, the improvement wherein a hydrophilic dye-barrier/subbing layer is located between said dye layer and said support, said dye-barrier/subbing layer comprising a mixture of a) polyvinyl alcohol from about 15 to about 35 weight-percent, and b) polyvinyl-pyrrolidone from about 65 to about 85 weight-percent of said mixture.

7. The process of claim 6 wherein said dye barrier layer is present in an amount of up to about 0.11 $g/m^2$.

8. The process of claim 6 wherein said support is poly(ethylene terephthalate) which is coated with sequential repeating areas of cyan, magenta and yellow dye, and said process steps are sequentially performed for each color to obtain a three-color dye transfer image.

9. In a thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein a hydrophilic dye-barrier/subbing layer is located between said dye layer and said support, said dye-barrier subbing layer comprising a mixture of 1) polyvinyl alcohol from about 15 to about 35 weight-percent, and 2) polyvinyl-pyrrolidone from about 65 to about 85 weight-percent of said mixture.

10. The assemblage of claim 9 wherein said dye barrier layer is present in an amount of up to about 0.11 $g/m^2$.

11. The assemblage of claim 9 wherein said support comprises poly(ethylene terephthalate).

12. The assemblage of claim 11 wherein said dye layer comprises sequential repeating areas of cyan, magenta and yellow dye.

13. The assemblage of claim 9 wherein said dye layer comprises a sublimable dye in a binder.

* * * * *